US007272341B2

(12) United States Patent
Jung et al.

(10) Patent No.: US 7,272,341 B2
(45) Date of Patent: Sep. 18, 2007

(54) ELECTROPHOTOGRAPHIC IMAGE FORMING APPARATUS

(75) Inventors: Woo-Chul Jung, Yongin-si (KR); Heung-Sup Jeong, Suwon-si (KR); Se-Hyun Lyu, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 153 days.

(21) Appl. No.: 11/247,241

(22) Filed: Oct. 12, 2005

(65) Prior Publication Data

US 2006/0127129 A1 Jun. 15, 2006

(30) Foreign Application Priority Data

Dec. 13, 2004 (KR) ..... 10-2004-0104821

(51) Int. Cl.
*G03G 15/00* (2006.01)
*G03G 21/16* (2006.01)

(52) U.S. Cl. ..... 399/111; 399/124

(58) Field of Classification Search ..... 399/111, 399/110, 124, 125
See application file for complete search history.

(56) References Cited

U.S. PATENT DOCUMENTS 6,453,135 B1 * 9/2002 Sameshima et al. ..... 399/110
6,571,073 B1 5/2003 Suzuki et al.
2003/0053819 A1 * 3/2003 Nomura et al. ..... 399/110
2005/0260011 A1 * 11/2005 Murayama et al. ..... 399/111
2005/0265746 A1 * 12/2005 Jung et al. ..... 399/111

FOREIGN PATENT DOCUMENTS

| | | |
|---|---|---|
| JP | 2000-321843 | 11/2000 |
| JP | 2002-287570 | 10/2002 |
| JP | 2004-163579 | 6/2004 |
| JP | 2005-157113 A * | 6/2005 |
| KR | 2001-0021065 | 3/2001 |

* cited by examiner

*Primary Examiner*—Sophia S. Chen
(74) *Attorney, Agent, or Firm*—Roylance, Abrams, Berdo & Goodman LLP

(57) ABSTRACT

Provided is an image forming apparatus. The image forming apparatus includes a print unit printing having a plurality of developer cartridges, each of which has a photoreceptor drum disposed therein. A plurality of fixing members are movable between a first position where the developer cartridges are installed and removed and a second position where the developer cartridges are fixed to the print unit. A pinion includes a female screw portion and a first sliding member includes a male screw portion that is engaged with the female screw portion, sliding backwards and forwards as the pinion rotates, and moving the fixing members to the first position or the second position.

17 Claims, 4 Drawing Sheets

ELECTROPHOTOGRAPHIC IMAGE FORMING APPARATUS

CROSS-REFERENCE TO RELATED PATENT APPLICATIONS

This application claims the priority of Korean Patent Application No. 10-2004-0104821, filed on Dec. 13, 2004, the entire disclosure of which is hereby incorporated by reference.

BACKGROUND OF THE INVENTION

1. Field of the Invention

The present invention relates to an image forming apparatus. More particularly, the present invention relates to an electrophotographic image forming apparatus having a detachable developer cartridge.

2. Description of the Related Art

An electrophotographic image forming apparatus produces an image by forming an electrostatic latent image, corresponding to a desired image, by scanning light onto a photosensitive medium charged to a uniform electrostatic potential. Then, the latent image is developed by providing toner thereto and the image developed on the photosensitive medium is transferred to a sheet of printing paper either directly or indirectly. Lastly, the transferred image is fused by applying heat and pressure thereto.

The electrophotographic image forming apparatus includes a developer cartridge containing a photosensitive medium and toner. The developer cartridge is replaced when the service life of the cartridge ends. Therefore, the developer cartridge is detachably installed on the main body of the image forming apparatus. Once the developer cartridge is installed, the cartridge has to be fixed tightly at a predetermined position.

Conventional printers employ a coupler driven by a drive motor to fix the developer cartridge to the main body. When the developer cartridge separates, the coupler is moved back to avoid interference with the installed developer cartridge. After the developer cartridge is installed and a door is closed, the drive motor is rotated. The coupler is advanced and coupled with one end of a photoreceptor drum. Accordingly, the replaced developer cartridge is fixed at a predetermined position. When the door is opened to detach the developer cartridge, the drive motor rotates in an opposite direction and the coupler moves back and separates from one end of the photoreceptor drum.

In the above described method of fixing a developer cartridge using a drive motor, when the supply of electricity is interrupted, for example, when a power supply unit of a main body of the image forming apparatus malfunctions, the coupler cannot move backwards; therefore, detachment of the developer cartridge from the apparatus is prevented.

Furthermore, in conventional printers, the coupler and one end of the photoreceptor drum have complementary shapes. Thus, if the developer cartridge is not installed properly, the coupler and one end of the photoreceptor drum cannot be coupled together. Consequently, the installation of the developer cartridge is obstructed.

Accordingly, there is a need for an improved electrophotographic image forming apparatus in which a developer cartridge can be fixed and detached independently of a drive motor.

SUMMARY OF THE INVENTION

An aspect of the present invention is to solve at least the above problems and/or disadvantages and to provide at least the advantages described below. Accordingly, an aspect of the present invention is to provide an improved electrophotographic image forming apparatus in which a developer cartridge can be fixed and detached independently of a drive motor.

According to an aspect of the present invention, there is provided an image forming apparatus comprising a print unit which prints has a plurality of developer cartridges. A plurality of fixing members are provided which are movable between a first position where the developer cartridges are installed and removed and a second position where the developer cartridges are fixed to the print unit. A pinion includes a female screw portion. A first sliding member includes a male screw portion that engages with the female screw portion and slides backwards and forwards as the pinion rotates to move the fixing members to the first position or the second position.

The image forming apparatus may further comprise a door which opens and closes one side of the print unit to install and remove the developer cartridges wherein the pinion rotates clockwise or counterclockwise by the opening and closing movement of the door and moves the first slide backwards and forwards. The image forming apparatus may further comprise a second sliding member which slides backwards and forwards as the door opens and closes and including a rack gear for rotating the pinion. The image forming apparatus may further comprise an elastic member returning the second sliding member to its original position when the door is closed.

The image forming apparatus may further comprise a plurality of supporting portions supporting an end portion of a photoreceptor drum of each developer cartridge when the developer cartridges are installed, wherein the plurality of fixing members face the plurality of supporting portions and contact the end portion of the photoreceptor drum when the fixing members are in the second position to fix the developer cartridge.

The image forming apparatus may further comprise a paper conveying belt which faces the photoreceptor drums of the plurality of developer cartridges and supports and transfers a sheet of paper. A plurality of transfer units are arranged so that the paper conveying belt is positioned between the photoreceptor drums and the transfer units to which transfer bias is applied.

According to another aspect of the present invention, there is provided an electrophotographic image forming apparatus, comprising a frame in which a plurality of developer cartridges, each of which has a photoreceptor drum disposed therein, are installed and a plurality of supporting portions are formed to support the photoreceptor of each of the developer cartridges. A plurality of fixing members are installed in the frame so that the fixing members are movable between a first position where the fixing members are removed from a position where face the plurality of supporting portions to install and remove the developer cartridges and a second position where the fixing members face the supporting portions and contact an end portion of the photoreceptor drum of each developer cartridge to fix the plurality of developer cartridges to the frame. A pinion includes a female screw portion and is rotatably installed on the frame. A first sliding member includes a male screw portion that is engaged with the female screw portion and slides backwards and forwards as the pinion rotates to move the fixing members to the first position or the second position.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the exemplary embodiments of the invention. Also, descriptions of well-known functions and constructions are omitted for clarity and conciseness.

Figure 1:
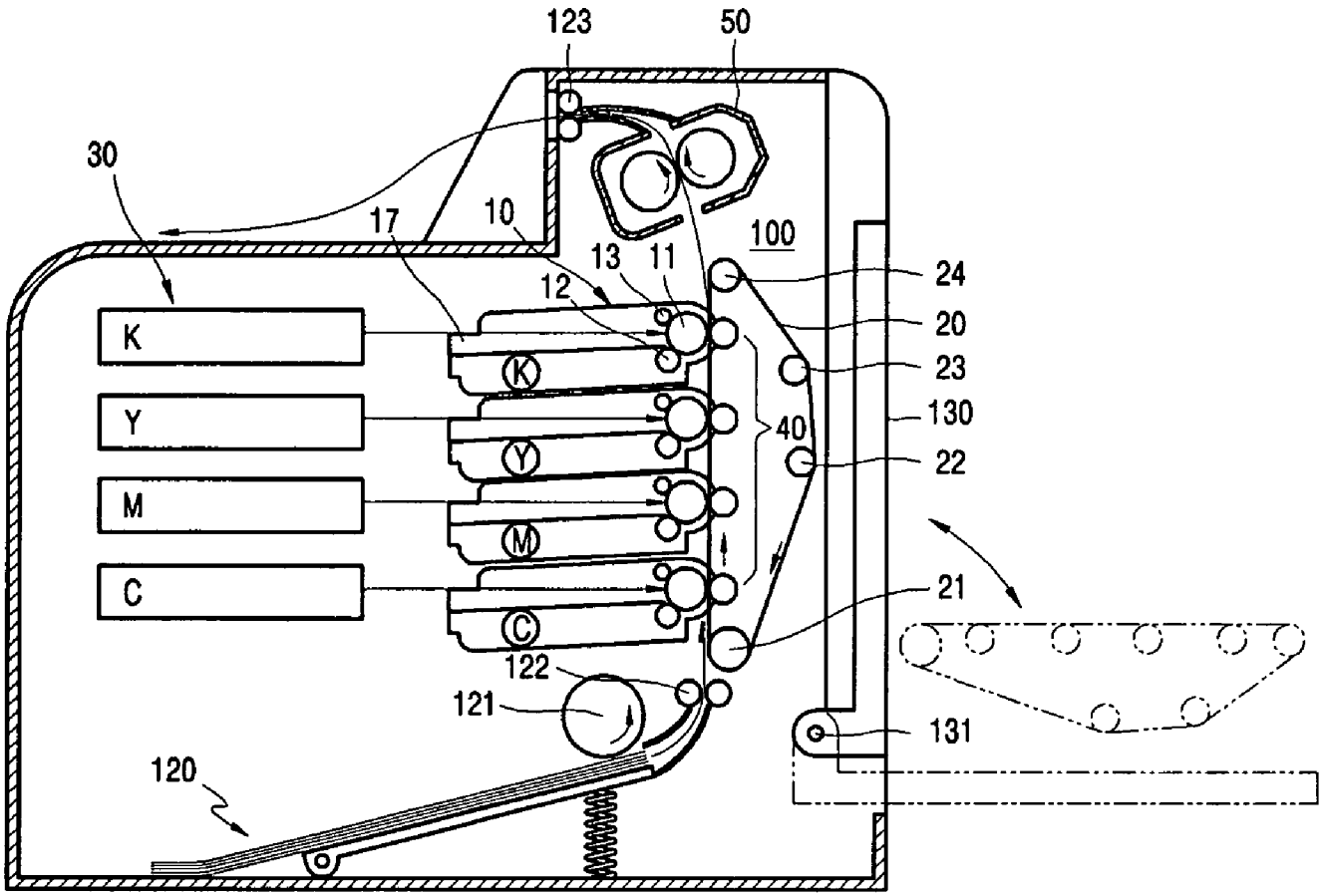
FIG. 1 is a configuration diagram of an electrophotographic image forming apparatus according to an exemplary embodiment of the present invention.

FIG. 1 is a configuration diagram of an electrophotographic image forming apparatus according to an exemplary embodiment of the present invention.

Referring to FIG. 1, the image forming apparatus includes a print unit 100 that prints an image onto a sheet of printing paper by an electrophotographic process, a cassette 120 that contains sheets of printing paper, a pick-up roller 121 that draws out a sheet of printing paper from the cassette 120, and feed rollers 122 that feed the sheet of printing paper.

The print unit 100 includes four developer cartridges 10C, 10M, 10Y and 10K that contain toner of different colors, for example, cyan (C), magenta (M), yellow (Y) and black (K) colors individually. The print unit 100 also has a paper conveying belt 20, scanning units 30C, 30M, 30Y and 30K, transfer rollers (transfer units) 40 and a fuser 50.

The paper conveying belt 20 circulates while being supported by a plurality of support rollers 21, 22, 23 and 24. The paper conveying belt 20 is preferably installed in a vertical direction; however, other suitable arrangements and constructions may be used. According to an embodiment, each scanning unit 30C, 30M, 30Y and 30K scans light corresponding to image data of cyan (C), magenta (M), yellow (Y) and black (K) colors onto each photoreceptor drum 11 of developer cartridges 10C, 10M, 10Y and 10K. In this embodiment, the scanning units 30C, 30M, 30Y and 30K may use laser diodes as light sources.

Each of the developer cartridges 10C, 10M, 10Y and 10K includes a photoreceptor drum 11 and a developing roller 12. Each developer cartridge 10C, 10M, 10Y and 10K further includes an electrostatic charging roller 13. A charging bias voltage is applied to the electrostatic charging roller 13 so that the outer circumference of the photoreceptor drum 11 is charged to a uniform electrostatic potential. Instead of the electrostatic charging roller 13, a corona discharger (not illustrated) may be used. The developing roller 12 provides toner to the photoreceptor drum 11 by adhering the toner on an outer circumference thereof. A developing bias is applied to the developing roller 12 to supply the toner to the photoreceptor drum 11. Although not illustrated in the drawings, each of the developer cartridges 10C, 10M, 10Y and 10K may further include a supply roller that adheres the toner to the developing roller 12, a regulating unit that regulates the quantity of toner adhered to the developing roller 12, and an agitator that transfers toner contained therein to the supply roller and/or the developing roller 12. Each of the developer cartridges 10C, 10, 10Y and 10K includes an opening 17 that forms a passage for light from the scanning unit 30C, 30M, 30Y or 30K to scan the photoreceptor drum 11. The outer circumference surfaces of the photoreceptor drums 11 face the paper conveying belt 20.

The four transfer rollers 40 are arranged so that the paper conveying belt 20 is positioned between the photoreceptor drums 11 of the developer cartridges 10C, 10M, 10Y and 10K and the four transfer rollers 40. A transfer bias voltage is applied to the transfer rollers 40.

The process of forming a color image with the above structure is described hereafter.

The photoreceptor drum 11 of each developer cartridge 10C, 10M, 10Y and 10K is charged to a uniform electrostatic potential by applying a charging bias voltage to the electrostatic charging roller 13. The four scanning units 30C, 30M, 30Y and 30K form an electrostatic latent image by radiating light corresponding to image data of respective cyan, magenta, yellow and black colors onto the photoreceptor drum 11 of each developer cartridge 10C, 10M, 10Y and 10K through the openings 17 therein. A developing bias voltage is applied to the developing roller 12. Then, toner adhered to the outer circumference of the developing roller 12, adheres to the electrostatic latent image, and consequently toner images of respective cyan, magenta, yellow and black colors are formed on the photoreceptor drum 11 of each developer cartridge 10C, 10M, 10Y and 10K.

A sheet of printing paper is picked up from the cassette 120 by the pick-up roller 121. The sheet of printing paper is transferred to the paper conveying belt 20 by the feed rollers 122. The sheet of printing paper adheres to the surface of the paper conveying belt 20 by static electricity and is fed at the same speed that the paper conveying belt 20 travels.

For example, a front end of paper reaches the transfer nip about the time when a front end of a cyan (C) toner image formed on the outer surface of the photoreceptor drum 11 of the developer cartridge 10C arrives at the transfer nip of the transfer roller 40. When a transfer bias voltage is applied to the transfer rollers 40, the toner images formed on the photoreceptor drums 11 are transferred to the sheet of printing paper. As the sheet of printing paper is fed, the magenta (M), yellow (Y) and black (K) toner images formed on the photoreceptor drum 11 of the developer cartridges 10M, 10Y and 10K are sequentially transferred to the sheet of printing paper in an overlapping manner. Thus, a color toner image is formed on the sheet of printing paper. The fuser 50 fixes the color toner image formed on the sheet of printing paper by applying heat and pressure. The sheet of printing paper to which the toner image has been fixed is discharged outside the image forming apparatus by discharging rollers 123. As described above, in the present exemplary embodiment, the toner image of the photoreceptor drum 11 is directly transferred without an intermediate transfer, and therefore, the structure of the image forming apparatus is simplified.

The developing cartridges 10C, 10M, 10Y and 10K are expendable supplies that have to be exchanged when their life span ends. Therefore, the developing cartridges 10C, 10M, 10Y and 10K in an exemplary embodiment are detachably installed from the print unit 100. Further, the image forming apparatus can simultaneously lock and unlock the developing cartridges 10C, 10M, 10Y and 10K in order to install or detach them according to the embodiment.

Figure 2:
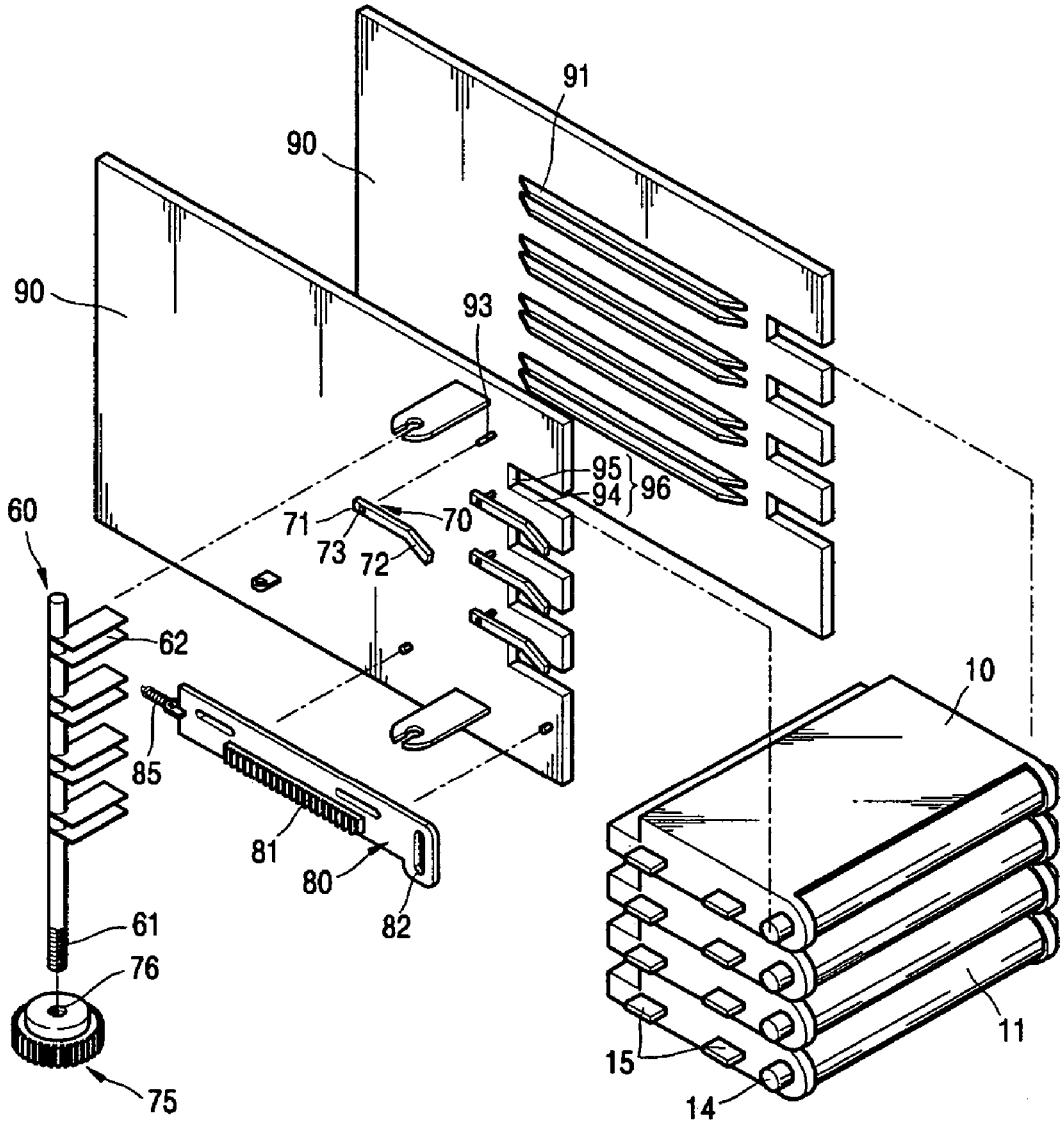
FIGS. 2 and 3 are an exploded perspective view and a side view of a structure for detaching a developer cartridge according to an exemplary embodiment of the present invention.
Figure 3:
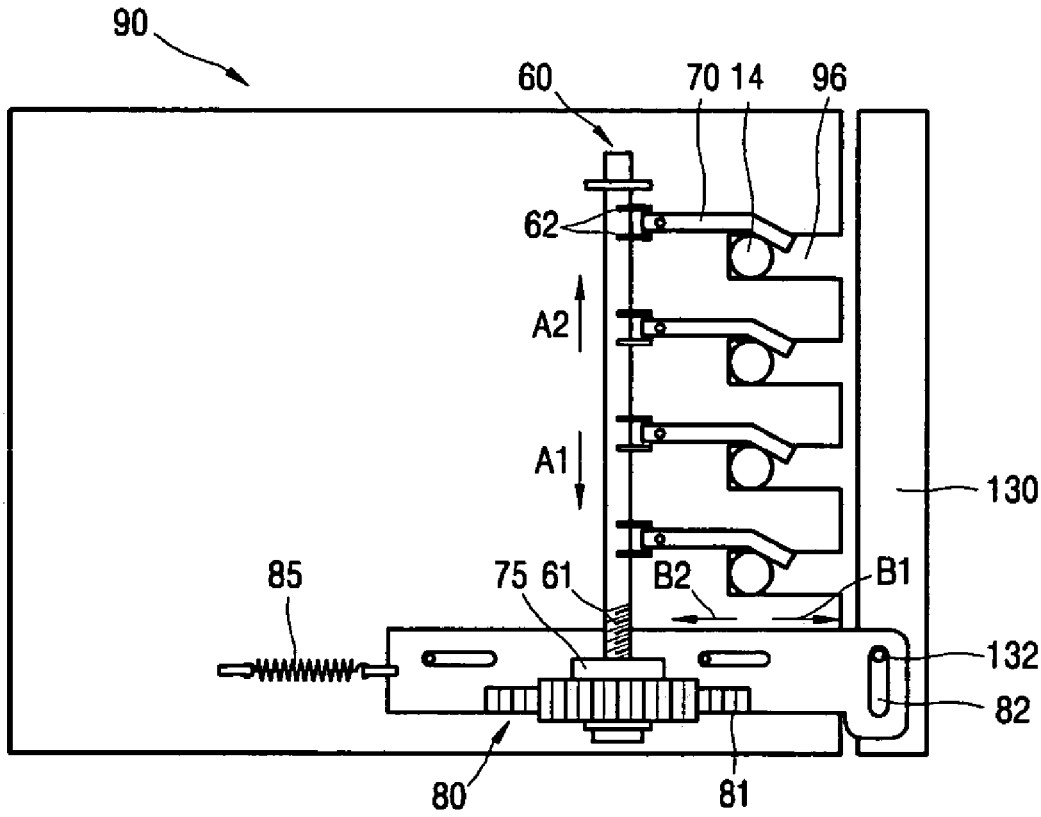

FIGS. 2 and 3 are an exploded perspective view and a side view of a structure which detaches a developer cartridge 10 in accordance with an exemplary embodiment of the present invention. In FIG. 2, a pair of frames 90 having respective guide rails 91 are illustrated. Protrusions 15 are arranged on both sides of the developer cartridge 10 and are adapted to be received by the guide rails 91. The developer cartridge 10 is installed and detached by sliding the developer cartridge along the guide rails 91 in a horizontal direction. End portions 14 of the photoreceptor drum 11 protrude toward sides of the developer cartridge 10. The frame 90 includes inserting portions 96 into which the end portions 14 of the photoreceptor drum 11 are supported when the developer cartridge 10 is installed. As shown in FIG. 2, the end portions 14 of the photoreceptor drum 11 commonly have circular shapes; however, other suitable shapes may be used. Therefore, preferably, the inserting portions 96 have a complementary shape which is capable of supporting at least two points of the end portions 14 of the photoreceptor drum 11. A door 130 is jointed to the frame 90. The door 130 opens and closes one side of the frame 90 by pivoting.

Fixing members 70 are joined to the frame 90. Each of the fixing members 70 may be in a first position where the developer cartridge 10 is allowed to be detached or a second position where the developer cartridge 10 is fixed or secured to the print unit 100.

According to an exemplary embodiment, the door 130 opens and closes one side of the print unit 100 by pivoting, as shown in FIG. 1. Here, the paper conveying belt 20 and the transfer rollers 40 rotate together. Accordingly, a paper transfer path is fully open, and therefore, a paper jam can be easily removed. The fixing member 70, according to an exemplary embodiment, pivots between the first and second positions about the pivot axis 93. An opening 73 in the fixing member 70 receives the pivot axis 93. The fixing member 70 has first and second arms 71 and 72 which extend from the opening 73.

The image forming apparatus according to an exemplary embodiment includes a first sliding member 60 and a pinion 75 so that the fixing member 70 can pivot between the first and second portions. The first sliding member 60 includes a male screw portion 61. The first sliding member 60 is connected to the first arm 71 of the fixing member 70. The pinion 75 is arranged to rotate about the frame 90. A female threaded portion 76 is engaged with the male threaded portion 61 of the first sliding member 60 and formed in the pinion 75. The first sliding member 60 slides backwards and forwards in the direction indicated by arrows A1 and A2 of FIG. 3 in accordance with clockwise rotation and counterclockwise rotation of the pinion 75. The first sliding member 60 has a pair of interfering arms 62. The first arm 72 is located between the interfering arms 62. When the first sliding member 60 slides backwards and forwards in the direction indicated by arrows A1 and A2 as the pinion 75 rotates clockwise or counterclockwise, the interfering arms 62 push or pull the first arm 71 of the fixing member 70 such that the fixing member 70 pivots between the first and second positions.

The first sliding member 60 is slid backwards and forwards by the clockwise rotation/counterclockwise rotation of the pinion 75, and accordingly, a plurality of fixing members can be moved to the first or second position. According to the present embodiment, the image forming apparatus includes the door 130 for opening and closing one side of the print unit 100 to install or detach the developer cartridges 10C, 10M, 10Y and 10K, and the pinion 75 is rotated clockwise or counterclockwise by the opening and closing movement of the door 130. The frame 90 includes a second sliding member 80. A shaft 132 is installed in the door 130 offset from the pivot center 131. A rack gear 81 that is engaged with the pinion 75 and a slot 82 to which the shaft 132 is inserted are formed in the second sliding member 80. When the door 130 is opened, the second sliding member 132 slides backwards and forwards in the direction indicated by arrows B1 and B2 of FIG. 3. The slot 82 is preferably slit-shaped so that the slot 82 remains in contact with the shaft 132 during the opening and closing of the door 130. A coil spring (elastic member) 85 provides a spring force such that the second sliding member 80 returns to the original position when the door 130 is closed.

Figure 4:
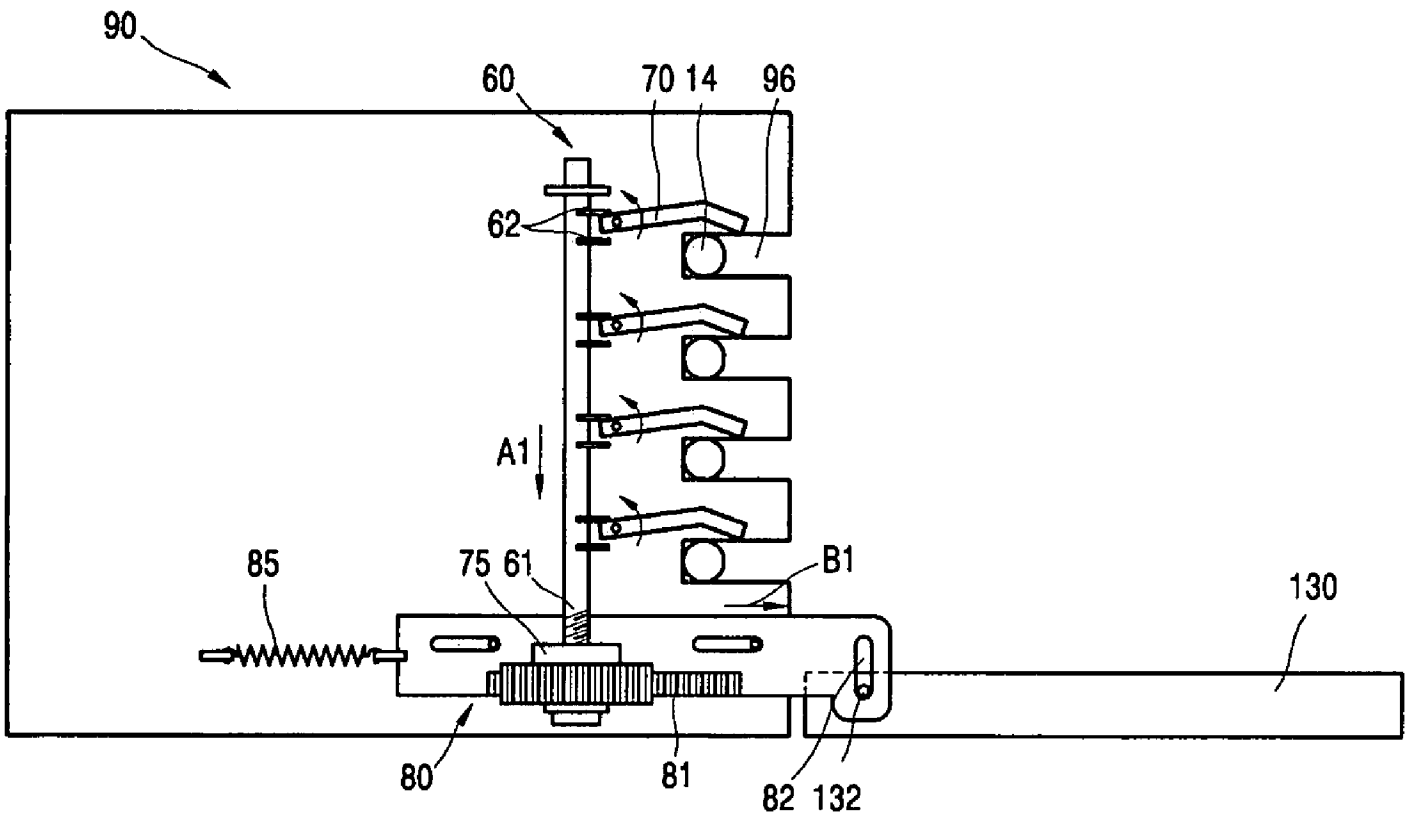
FIG. 4 is a side view of a frame of the electrophotographic image forming apparatus when a door is open.

Referring to FIG. 3, the fixing member 70 is initially in the second position. The second arm 72 of the fixing member 70 is in a position to face a supporting portion 96. The door 130 is pivoted as shown in FIG. 4, and one side of the print unit 100 is opened. Then, the second sliding member 80 slides in the direction indicated by the arrow B1, and the pinion 75 rotates. The first sliding member 60 slides in the direction indicated by the arrow A1. The pair of interfering arms 62 push the first arm 71 of the fixing member 70 so that the fixing member 70 pivots. Accordingly, the first fixing member 70 is removed from the position where the second arm 72 faces the supporting portion 96, and pivots to the first positron where the developer cartridge 10 is removed. A user may pull the developer cartridge 10 to remove the cartridge from the print unit 100.

When the developer cartridge 10 is installed in the print unit 100, the fixing member 70 is in the first position by opening the door 130. When the developer cartridge 10 is inserted along a guide rail 91, the end portion 14 of the photoreceptor 11 is inserted into the supporting portion 96. The end portion 14 is supported on two points by the first side 94 and the second side 95. Then, the door 130 is closed. The second sliding member 80 slides in the direction indicated by the arrow B2. The interfering arms 62 pull the first arm 71 of the fixing member 70 so that the fixing member pivots to the second position. The second arm 72 of the fixing member 70 that faces the supporting portion 96 contacts the end portion 14 of the photoreceptor drum 11. The developer cartridge 10 is fixed while being supported on three points by the supporting portion 96 and the second arm 72 of the fixing member 70. Therefore, even if the developer cartridge is not fully inserted in the supporting portion 96, the fixing member 70 pivots and pushes the end portion 14 of the photoreceptor drum 11 for complete insertion in the supporting portion 96. Further, the fixing member 70 does not pivot and is locked in the second position unless the door 130 is opened. Accordingly, the developer cartridge 10 is firmly installed in the print unit 100.

As described above, in the image forming apparatus according to exemplary embodiments of the present invention, the developer cartridge 10 is installed in or removed from the print unit 100 by the fixing member 70, which moves in synchronization with the opening and closing of the door 130. Therefore, regardless of receiving power supply, the developer cartridge 10 may be installed in or detached from the print unit 100. Further, since the structure of the image forming apparatus according to the exemplary embodiments of the present invention is simpler than that of a conventional image forming apparatus using a drive motor and the costs for parts and assembling the parts may be reduced.

The image forming apparatus may include a rotating device so that a user can rotate clockwise or counterclockwise the pinion 75 in the outside although the rotating device is not illustrated in drawings. For example, a handle (not shown) may be installed in the second sliding member 80 while being exposed to the outside of the image forming apparatus so that the user can slide the second sliding member 80 in the direction indicated by arrow B1 or B2.

Although the image forming apparatus having four developer cartridges 10 has been described in the above embodiments, the scope of the exemplary embodiments of the present invention is not limited to this number of developer cartridges.

As described above, according to the exemplary embodiments of the present invention, an electrophotographic image forming apparatus with a simple structure allows developer cartridges to be installed in or removed from a print unit regardless of receiving power supply may be implemented.

While the present invention has been particularly shown and described with reference to exemplary embodiments thereof, it will be understood by those of ordinary skill in the art that various changes in form and details may be made therein without departing from the spirit and scope of the exemplary embodiments of the present invention as defined by the following claims.

What is claimed is:

1. An image forming apparatus, comprising:

a print unit having a plurality of developer cartridges;

a plurality of fixing members movable between a first position where the developer cartridges are installed and removed and a second position where the developer cartridges are fixed to the print unit;

a pinion including a female threaded portion;

a first sliding member, including a male threaded portion which engages with the female screw portion, which slides backwards and forwards as the pinion rotates to move the fixing members to the first position or the second position.

2. The image forming apparatus of claim 1, further comprising:

a door which opens and closes one side of the print unit to install and remove the developer cartridges, wherein the pinion rotates clockwise or counterclockwise by the opening and closing movement of the door and moves the first slide backwards and forwards.

3. The image forming apparatus of claim 2, further comprising:

a second sliding member sliding backwards and forwards as the door opens and closes and including a rack gear for rotating the pinion.

4. The image forming apparatus of claim 3, further comprising:

an elastic member returning the second sliding member to its original position when the door is closed.

5. The image forming apparatus of claim 1, further comprising:

a plurality of supporting portions supporting an end portion of a photoreceptor drum of each developer cartridge when the developer cartridges are installed, wherein the plurality of fixing members face the plurality of supporting portions and contact the end portion of the photoreceptor drum when the fixing members are in the second position to fix the developer cartridge.

6. The image forming apparatus of claim 1, further comprising:

a paper conveying belt which faces the photoreceptor drums of the plurality of developer cartridges and supports and transfers a sheet of paper; and a plurality of transfer units which are arranged so that the paper conveying belt is positioned between the photoreceptor drums and the transfer units and to which transfer bias is applied.

7. The image forming apparatus of claim 6, wherein the paper conveying belt and the transfer units are installed proximate to the door.

8. An electrophotographic image forming apparatus, comprising:

a frame in which a plurality of developer cartridges, each of which has a photoreceptor drum disposed therein, are installed and a plurality of supporting portions are formed to support the photoreceptor of each of the developer cartridges;

a plurality of fixing members which are installed in the frame so that the fixing members are movable between a first position where the fixing members are removed from a position facing the plurality of supporting portions to install and remove the developer cartridges and a second position where the fixing members face the supporting portions and contact an end portion of the photoreceptor drum of each developer cartridge to fix the plurality of developer cartridges to the frame;

a pinion, which includes a female threaded portion, is rotatably installed in the frame; and a first sliding member, which includes a male threaded portion that is engaged with the female threaded portion, slides backwards and forwards as the pinion rotates to move the fixing members to the first position or the second position.

9. The electrophotographic image forming apparatus of claim 8, further comprising:

a door which opens and closes one side of the frame to install and remove the developer cartridges, wherein the pinion is rotated clockwise or counterclockwise by the opening and closing movement of the door to move the first sliding member backwards and forwards.

10. The electrophotographic image forming apparatus of claim 9, further comprising:

a second sliding member sliding backwards and forwards as the door is opened and closed and including a rack gear for rotating the pinion.

11. An electrophotographic image forming apparatus, comprising:

a print unit which prints an image by an electrophotographic process having a plurality of developer cartridges, each of which has a photoreceptor drum disposed therein;

a plurality of fixing members movable between a first position where the developer cartridges are installed and removed and a second position where the developer cartridges are fixed to the print unit;

a pinion including a female screw portion;

a first sliding member, including a male screw portion which engages with the female screw portion, which slides backwards and forwards as the pinion rotates to move the fixing members to the first position or the second position.

12. The electrophotographic image forming apparatus of claim 11, further comprising:

a door which opens and closes one side of the print unit to install and remove the developer cartridges, wherein the pinion rotates clockwise or counterclockwise by the opening and closing movement of the door and moves the first slide backwards and forwards.

13. The electrophotographic image forming apparatus of claim 12, further comprising:

a second sliding member sliding backwards and forwards as the door opens and closes and including a rack gear for rotating the pinion.

14. The electrophotographic image forming apparatus of claim 13, further comprising:

an elastic member returning the second sliding member to its original position when the door is closed.

15. The electrophotographic image forming apparatus of claim 14, further comprising:

a plurality of supporting portions supporting an end portion of the photoreceptor drum of each developer cartridge when the developer cartridges are installed, wherein the plurality of fixing members face the plurality of supporting portions and contact the end portion of the photoreceptor drum when the fixing members are in the second position to fix the developer cartridge.

16. The electrophotographic image forming apparatus of claim 15, further comprising:

a paper conveying belt which faces the photoreceptor drums of the plurality of developer cartridges and supports and transfers a sheet of paper; and a plurality of transfer units which are arranged so that the paper conveying belt is positioned between the photoreceptor drums and the transfer units and to which transfer bias is applied.

17. The electrophotographic image forming apparatus of claim 16, wherein the paper conveying belt and the transfer units are installed proximate to the door.

* * * * *